US005290068A

United States Patent [19]

Gundjian

[11] Patent Number: 5,290,068

[45] Date of Patent: Mar. 1, 1994

[54] DOCUMENT SECURITY METHOD AND SYSTEM

[75] Inventor: Arshevir Gundjian, Montreal, Canada

[73] Assignee: Nocopi International Ltd., Montreal, Canada

[21] Appl. No.: 778,808

[22] PCT Filed: Jun. 29, 1990

[86] PCT No.: PCT/CA90/00203

§ 371 Date: Dec. 16, 1991

§ 102(e) Date: Dec. 16, 1991

[87] PCT Pub. No.: WO91/00390

PCT Pub. Date: Jan. 10, 1991

[30] Foreign Application Priority Data

Jul. 5, 1989 [GB] United Kingdom ..... 8915400

[51] Int. Cl.[5] ..... B42D 15/00

[52] U.S. Cl. ..... 283/67; 283/91; 283/902

[58] Field of Search ..... 283/91, 902, 67

[56] References Cited

U.S. PATENT DOCUMENTS 4,037,007 7/1977 Wood ..... 428/199

FOREIGN PATENT DOCUMENTS 90130 10/1983 European Pat. Off. .
588565 11/1933 Fed. Rep. of Germany .
874142 4/1953 Fed. Rep. of Germany .
2518871 11/1975 Fed. Rep. of Germany .
2315132 1/1977 France .
2410565 6/1979 France .
1507454 4/1978 United Kingdom .
2052587 1/1981 United Kingdom .

*Primary Examiner*—Paul A. Bell
*Attorney, Agent, or Firm*—Sprung Horn Kramer & Woods

[57] ABSTRACT

A method and system for securing a substrate such as paper and the like against counterfeiting, photocopying, and facsimile transmission and an applicator and paper for use in the method and system and with the applicator. The method and system comprises providing a substrate having a background color on one surface thereof, covering at least one selected area of the surface with one of the colorless color developer and a colorless color former dye, wherein the color developer and color former dye react when mixed to produce a first given color which is different form the background color and applying the other of the colorless color developer and the colorless color former dye to at least a portion of the at least one selected area to change the background color to said first given color.

45 Claims, 3 Drawing Sheets

DOCUMENT SECURITY METHOD AND SYSTEM

BACKGROUND OF THE INVENTION

The present invention relates to a method and system for securing a substrate such as paper and the like against counterfeiting, photocopying, and facsimile transmission and an applicator and paper for use in the method and system and with the applicator, that is to say paper which when carrying information in a conventional black or similar dark color cannot be readily photocopied or transmitted by telefacsimile in a visually readable manner and is resistant to counterfeiting.

The present day availability of improved photocopiers has increased the problem of rendering documents or portions thereof resistant to photocopying in a readable manner. Moreover, the latest generation of color photocopiers has made it easier to counterfeit valuable documents. Antiphotocopying paper which is successful in preventing visually readable photocopying by most present day photocopiers is described in U.S. Pat No. 4,522,429 (Gardner et al) issued Jun. 11, 1985, U.S. Pat. No. 4,632,429 (Gardner et al) and U.S. Pat. No. 4,867,481 (Gundjian).

U.S. Pat. No. 4,522,429 teaches the use of antiphotocopying paper having a color with a reflection spectral response of less than about 10% for light with a wavelength below about 600 milimicrons and yet which is sufficiently visually contrasting with information, when such information is typed thereon or otherwise applied thereto, to enable such information to be read by the human eye when the paper is viewed under which light.

U.S. Pat. No. 4,632,429 teaches the use of antiphotocopying paper with a front face having a color with a reflection spectral response which is effectively zero for light with a wavelength below about 625 millimicrons and less than about 1% up to about 1,000 millimicrons so as to render the paper substantially incapable of being photocopied in an information readable manner, after substantially non-translucent information has been typed or otherwise applied to the front face, the paper being capable of transmitting visible light from a rear face to the front face to cause sufficient contrast between the substantially non-translucent information and the transmitted light to enable the information to be read by a human eye viewing the front face of the paper when visible light is transmitted through the paper from the rear face to the front face thereof.

Anti-photocopying paper of the type described in the abovementioned patents satisfactorily fulfills most present day needs, and represents a very significant improvement over prior proposals which were not successful in practice. Such paper is also resistant to transmission by telefacsimile.

The increasing photocopying ability of new generation photocopiers presented a need for still further improved anti-photocopying paper.

A further improved anti-photocopying and anti-telefacsimile effect has been achieved by the spatial, spectral modulation of the paper reflectance at a specific single or preferably, multiple spatial frequencies as disclosed in U.S. Pat. No. 4,867,481 (Gundjian).

Given all the above, it has, however, been recognized that the requirement for the feature of uncopiability on a document is often limited to a selected and limited portion of the said document. Furthermore, having also recognized that generally, it is only after the printing, typing or otherwise transfer of the information to a paper, that the portions of the latter that are required to be secured and hence to exhibit qualities of uncopiability are identified, the present invention has been worked out.

SUMMARY OF THE INVENTION

The present invention provides now, a method whereby, after a text is printed on a document, selected portions of the latter, while remaining visually readable, are rendered, uncopiable through photocopying or telefacsimile transmission.

Some attempts have previously been made to achieve this result, by using certain highlighter pens to "cover" such portions of the text with a colored trace that was expected to produce a blocking black trace upon photocopying. This method gives unsatisfactory results, indeed the exposure setting of present day photocopiers can usually be adjusted to a level that renders such highlighter traces ineffective. One the other hand, when the highliter pen is forced to lay down a very heavy and dark blocking trace, the visual readability of the protected text then becomes dramatically impaired.

Generally speaking, the attempt to use any sort of blocking film overlay such a sometimes in the form of a thin colored plastic sheet, or a colored ink trace, on top of an underlying text or other information, with the purpose of achieving total uncopiability of the latter, is bound to failure in view of the fact that the color strength or color density of the areas corresponding to the text or information in the original document, is automatically added to that of the overlay film. Thus the absolute value of the contrast differential between the portions of the paper that carry the information, relative to the blank spaces remains unchanged, no matter how strong one renders the overlying film color density. This constant contrast differential attributes a remanent copiability to the text portions even though the paper-film combination darkness is increased.

The present invention provides a fundamental breakthrough that eliminates the basic obstacle described above. This invention is based on the successful development in the past several years of leuco dye and color developer pairs of chemicals which separately appear as colorless chemicals but which when chemically mixed can develop a strong color. Such pairs of chemicals are widely used in the carbonless and thermal paper technology which evolve around the development of different ingenious schemes to keep the two components physically separate, until a strong local pressure or heat is applied on the paper sheet causing the mixing of the two chemicals and hence making a colored usually black trace appear on the otherwise white paper.

The present invention aims at a completely different configuration for the use of leuco dye and color former pairs of chemicals. This new configuration provides a scheme which results in the selective transformation of an initially essentially white or lightly colored paper background, into a background of a well controlled optical characteristic. This transformation can take place either before or after the sensitive information to be protected, is printed or written on said portion of the document, irrespective of the latter the sensitive information will appear as if it were lying on top of the secured background.

The present invention, as regards anticopying and resistance to facsimile transmission will thus provide two important features:

a) A background spectral characteristic which will be as prescribed below, will only appear in selected parts of the otherwise white or light colored paper, at the choice of the person using the paper.

b) The spectral characteristic of the printed areas corresponding to the information will remain essentially unaffected, by the development of the background color, irrespective of whether the sensitive information is printed on the white paper before or after the background having special spectral characteristics is made to develop using the present invention.

In simpler terms the printed information will remain optically on top of the background color and pattern as shown in FIG. 1*b*, even though the latter may and will have been produced after the printing of the information on the originally white or light colored paper. This feature is one of the major achievements of this invention, since it overcomes a basic obstacle mentioned above, that prevented the use of simple highlighter pens to render selected parts of a document uncopiable.

With regard to the anticounterfeiting aspect of the invention, it is noted that when the paper is specially coated as the substrate for the printing of valuable documents, such documents are automatically protected very effectively against fraudulent attempts of duplication i.e. counterfeiting. Indeed the characteristics of the paper coating are invisible and therefore, undetected by any copying method. Information carried by an unactivated paper substrate may thus be in a first step fraudulently reproduced, however, the fraudulent reproduction can obviously not convey the so called hidden characteristic of the original substrate to the new substrate. The duplication of the original documents thus now becomes a very simple and effective exercise through the use of a chemical system dispenser or applicator such as a marker pen containing the other chemical component. When the latter is applied to the original document, the expected colored pattern will appear, the fraudulent reproduction substrate, however, will be absolutely inert and will not be able to develop the expected colored feature when tested with the chemical system carrying dispenser. Alternatively if a scrambler pattern on the document is activated, the document cannot be copied in a color copier.

These and other objects of the present invention are achieved in accordance with the present invention by a method of securing a substrate such as paper and the like against counterfeiting, photocopying and facsimile transmission, comprising the steps of providing a substrate having a background color on one surface thereof, covering at least one selected area of the surface with one of a colorless color developer and a colorless color former dye, wherein the color developer and color former dye react when mixed to produce a first given color which is different from the background color and applying the other of the colorless color developer and the colorless color former dye to at least a portion of the at least one selected area to change the background color to said first given color.

In accordance with the invention, information can be printed in the one selected area before or after the step of applying.

The step of covering comprises applying the color developer or the color former dye with a variable surface density, preferably in a regular predefined pattern. In one embodiment, step of covering comprises applying a first layer having a uniform surface density ad applying a second layer thereover having a variable surface density in accordance with the regular predefined pattern. The first layer is preferably a relatively lower activity color developer and the second layer is a relatively higher activity color developer. In a particularly preferred embodiment, the step of applying comprises applying a mixture of different color dyes.

In a preferred embodiment, the step of covering comprises uniformly coating the at least one selected area with a first color former dye to produce the first given color when mixed with a color developer and printing a second color former dye on the first color former dye in a regular pattern to produce a second given color which is different from the first given color and the background color when the second color former dye is mixed with a color developer whereby a spatial modulation of the first given color is effected with the second given color in accordance with the regular pattern.

In one embodiment, one (color A) of the first and second given colors has a reflection spectral response with a minimum $R_{minA}$ of about 5–10% at lower visible wavelengths, rising to about 10–14% at a wavelength of about 580 nanometers, and then rising to a maximum $R_{maxA}$ of about 20–25% at about 700 nanometers, and the other (color B) of said first and second given colors has a reflection spectral response with a minimum $R_{minB}$ of about 4–8% at lower visible wavelengths, rising to about 6–8% at a wavelength of about 580 nanometers, and then rising to a maximum $R_{maxB}$ of about 12–15% at about 700 nanometers. The reflectivity of color B remains below that of color A across the entire spectrum. Preferably, the reflection spectral response of said first and second given colors falls to said minimum at wavelengths above 700 nanometers.

Alternatively, one (color C) of said first and second given colors has a reflection spectral response with a maximum $R_{maxC}$ of about 20–25% at lower visible wavelengths, falling to about 10–15% at a wavelength of about 480 nanometers, and falling to a minimum $R_{minC}$ of about 8–10% at higher wavelengths, and the other (color D) of said first and second given colors has. a reflection spectral response with a maximum $R_{maxD}$ of about 12–15% at lower visible wavelengths, falling to about 8–10% at about 480 nanometers and falling to a minimum $R_{minD}$ of about 5–8% at higher wavelengths. The reflectivity of color D remains below that of color C across the entire spectrum. Preferably, the reflection spectral response of said first and second given colors falls to said minimum at wavelengths below about 400 nanometers.

In a particularly preferred embodiment, the step of applying comprises applying a single color developer to the surface to produce a change in color of both the first and second color former dyes and said spatial modulation.

The step of applying comprises painting a color developer solution on the surface with a handheld applicator or printing a color developer solution on the surface.

In another embodiment, a scrambling pattern in a second given color different from the background color and the first given color is printed in the at least one selected area and wherein the step of covering comprises applying a layer with a uniform surface density. Alternatively, a second given color different from the background color and the first given color is printed with a uniform surface density in the at least one selected area and wherein the step of covering comprises applying a layer with a variable surface density.

In still another preferred embodiment, glossing agents are added to at least one of the color developer and the color former dye.

The objects of the present invention are also achieved in accordance with the present invention by a system for securing a substrate such as paper and the like against counterfeiting, photocopying and facsimile transmission, comprising a substrate having a background color on one surface thereof, a covering of one of a colorless color developer and a colorless color former dye on at least one selected area of the surface, wherein the color developer and color former dye react when mixed to produce a first given color which is different from the background color and means for applying the other of the colorless color developer and the colorless color former dye to at least a portion of the at least one selected area to change the background color to said first given color.

The background color is preferably white, but can be any light or dark color. The color former dye preferably comprises a mixture of different color dyes.

In accordance with the invention, information can be printed in the one selected area before or after the means for applying is used.

The covering comprises the color developer or the color former dye having a variable surface density, preferably in a regular predefined pattern. In one embodiment, the covering comprises a first layer having a uniform surface density and a second layer thereover having a variable surface density in accordance with the regular predefined pattern. The first layer is preferably a relatively lower activity color developer and the second layer is a relatively higher activity color developer. In a particularly preferred embodiment, the means for applying comprises means for applying a mixture of different color dyes.

In a preferred embodiment, the covering comprises a uniform coating of the at least one selected area with a first color former dye to produce the first given color when mixed with a color developer and a second color former dye printed on the first color former dye in a regular pattern to produce a second given color which is different from the first given color and the background color when the second color former dye is mixed with a color developer whereby a spatial modulation of the first given color is effected with the second given color in accordance with the regular pattern.

In a particularly preferred embodiment, the means for applying comprises means for applying a single color developer to the surface to produce a change in color of both the first and second color former dyes and said spatial modulation.

The means for applying comprises means for painting a color developer solution on the surface comprising a handheld applicator or means for printing a color developer solution on the surface.

In another embodiment, a scrambling pattern in a second given color different from the background color and the first given color is printed in the at least one selected area and wherein the covering comprises a layer with a uniform surface density. Alternatively, a second given color different from the background color and the first given color is printed with a uniform surface density in the at least one selected area and wherein the covering comprises a layer with a variable surface density.

In still another preferred embodiment, glossing agents are added to at least one of the color developer and the color former dye.

The objects of the present invention are further achieved in accordance with the present invention by a security paper comprising one surface having a background color and a covering of one of a colorless color developer and a colorless color former dye on at least one selected area of the surface, wherein the color developer and color former dye react when mixed to produce a first given color which is different from the background color.

The objects of the present invention are still further achieved in accordance with the present invention by a handheld applicator comprising a body portion configured to be held in the hand of a user and having means forming a liquid chamber therein and an applicator tip in liquid communication with the chamber and one of a colorless color developer and a colorless color former dye, wherein the color developer and color former dye react when mixed to produce a first given color.

These and other features and advantages of the present invention will become more evident from the following detailed description and the attached drawings referred to therein, wherein:

DETAILED DESCRIPTION OF THE INVENTION

Figure 1A:
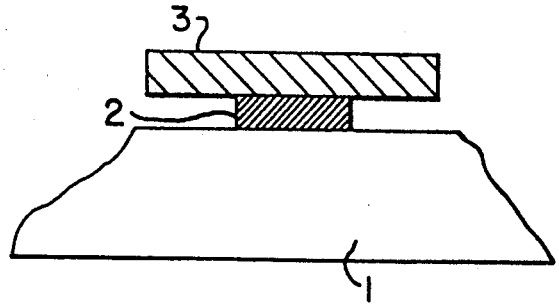
FIG. 1*a* is a cross section of a conventional anticopying paper.

In any embodiment of this invention two complementary chemical systems are involved, such that one of the chemical systems is applied onto the paper substrate while the second chemical system is carried by an appropriate applicator or dispenser which is used to apply the other chemical system onto the first one, i.e. to the coating of the paper substrate. When these two complementary chemical systems come into intimate contact and react with each other, the paper coating acquires a colored characteristic described below such that any information printed, typed or otherwise transferred to the paper substrate in that same area will be unreproducible by photocopying or prevented from transmission by telefacsimile equipment.

Examples of these complementary chemical systems are as follows:

CHEMICAL A

These are the leucodyes commercially available as one of the following, or in combination:

Copikem 14, Copikem Magenta, Copikes 6, Copikem 4 made by Hilton-Davis, Pergascript Orange I-5R, Pergascript Red I-6B, Pergascript Green I-3G, Pergascript Yellow I-3R made by Ciba-Geigy, Reakt Red 448, Reakt Yellow 186 made by BASF.

CHEMICAL B

These are color developers, commercially available as one of the following or in combination:

Zincated, modified alkyphenol activator HRJ. -10138; the Alkylphenol Novolac resin activator HRJ-2609 as made by Schenectady Chemicals Inc.; the chemical zinc chloride $ZnCl_2$.

In one embodiment of this invention, ordinary printing or writing white paper is preprinted or coated with a layer of a colorless, color developer preferably integrated into a phenolic resin or other appropriate lacquer solution both for printing and for imparting potentially good paper surface finish. This color developer coating constitutes the first chemical system. The lacquer or resin vehicle for the color developer makes it possible to simultaneously add gloss to the surface of the paper, since the specular reflection characteristics are found to be an important feature to enhance the uncopiability of the final product. For a further improvement of the uncopiability feature in this embodiment of the invention it is required, that the color developer coating instead of being of a uniform surface density, as usually is the case, be rather produced with an orderly variable surface density, according to a well defined pattern. This can be achieved for example by applying the coating in two successive printing steps, whereby, int eh first printing step the paper is coated uniformly with a relatively lower activity color developer coating, and in the second step a highly active developer solution is printed over the first uniform coating according to a prescribed pattern. It is now easily understood that when as a final operation the color former leucodye is applied to this surface, a corresponding colored pattern will develop.

The spatial and spectral features of this pattern are such that they will preferably result in the spatial modulation of the spectral characteristics of the treated area of the paper essentially as described in U.S. Pat. No. 4,867,481 (Gundjian), the contents of which are incorporated herein by reference.

Figure 7:
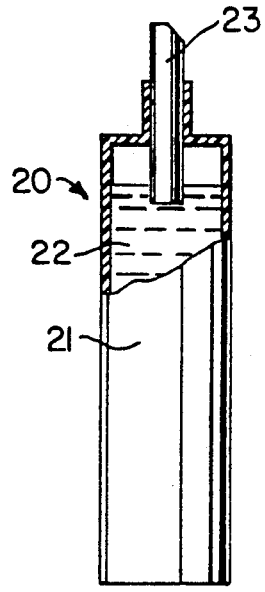
FIG. 7 is a partial sectional view of an applicator according to the present invention.

The colorless color former dye that constitutes the second chemical system is to be applied to the above described coated paper, using typically a marker pen as shown in FIG. 7. It will consist normally of a mixture rather than a single fluorine. The mixture is such that the color that is developed on the paper surface after the color former dye gets in contact with the paper coating as shown in FIG. 3, corresponds to the spectral characteristic prescription shown as A and B in FIG. 2 as discussed in the U.S. Pat. No. 4,867,481 (Gundjian).

One possible combination of fluorans will be a red developing, a black developing and a blue developing color former mixture.

Figure 2A:
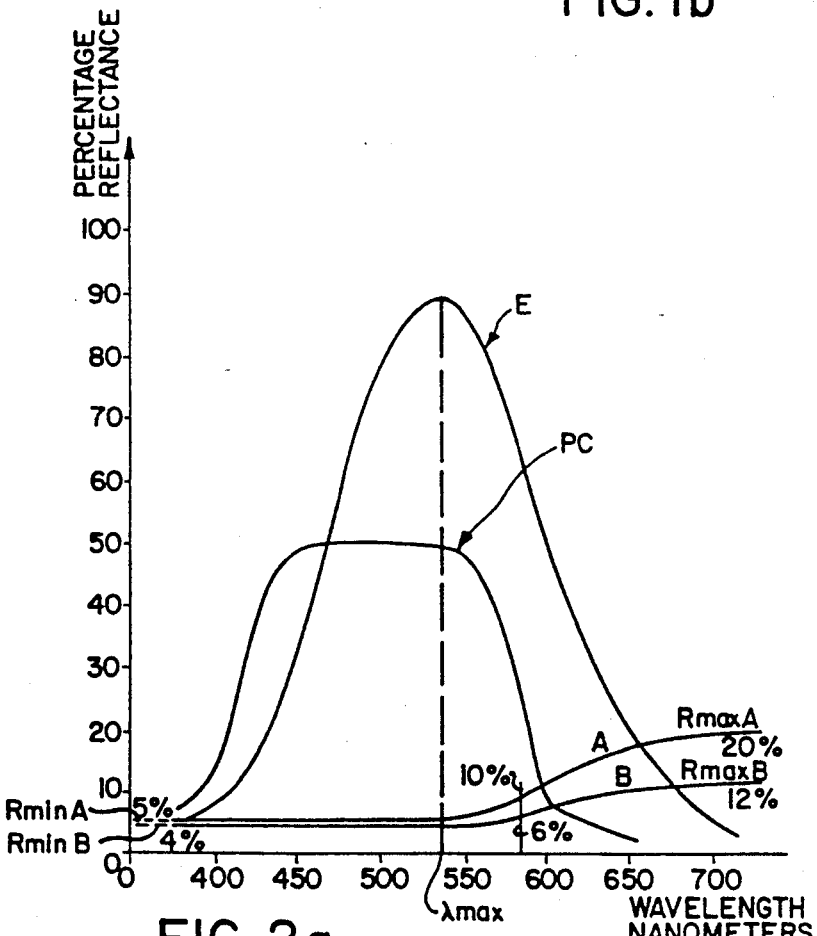
FIGS. 2*a* and 2*b* are graphs showing the reflection spectral response of two colors and also showing the average spectral response of the human eye and a typical spectral response of a photocopier.
Figure 2B:
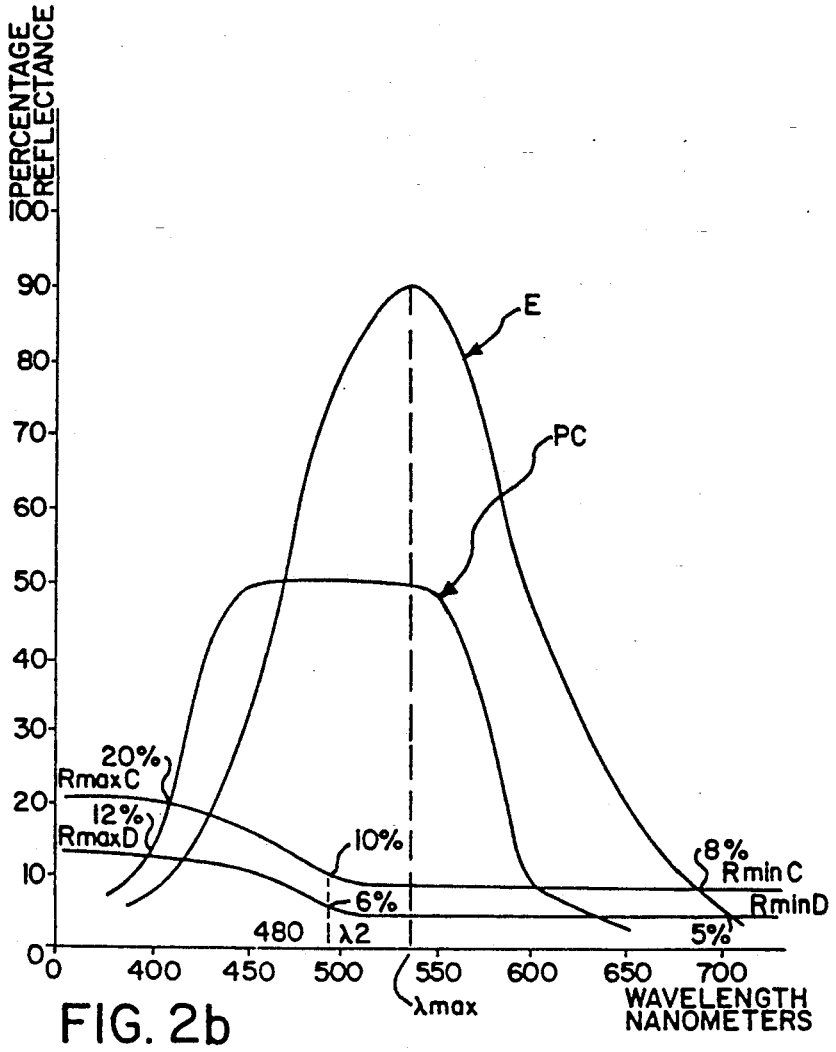
Figure 3:
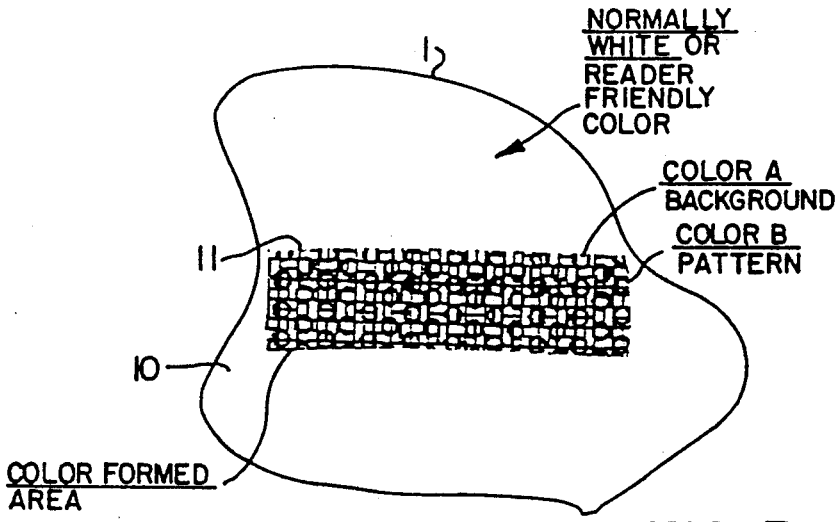
FIG. 3 is a plan view of the security paper according to the present invention showing a color formed area with a uniform color and a scrambling pattern.

The mixture of the fluorans and the variable density of the preprinted color developer as described above, is such that the developed colors A and B of FIG. 3 exhibit appreciably the spectral responses described in FIG. 2*a*. The visual appearance of the color transformed area will be as shown in FIG. 3. The A and B spectral characteristics are implemented such that the cut off wavelength L, is at least 580 nm, preferably at least 600 nm or more preferably at least 610 to 630 nm. Alternatively developed colors C and D can be used having the spectral characteristics shown in FIG. 2*b*.

In an alternate embodiment of this invention the order of application of the two chemical systems, namely the color developer activator and the color forming leucodyes is reversed.

Thus, the original white paper is first coated with a first chemical system that consists in this case, of the color forming fluorans, preferably with a two step printing or coating process, whereby in the first step a uniform coating is applied using a mixture of colorless fluorans that upon getting in contact with a color developer will result in a color appreciably matching color and in a second step a different mixture of colorless fluorans which in turn after being put in contact with the color developer results eventually in a color appreciably matching color B being printed over the initial coating according to the pattern shown in FIG. 3 that corresponds to the spatial modulation of the background of color a, with color B. It is understood, that up to this point this novel paper device still appears to be of a very light color that can be at the limit white, or a prechosen specific color that serves to identify this novel security paper.

In this second embodiment of the invention the colorless color developer, of a given strong concentration constitutes the second chemical system, is loaded into a convenient applicator device of which the simplest form is that of a marker pen as shown in FIG. 7. As in the first embodiment of this invention, a gloss i.e. specular reflection adding component such as a lacquer is added to the marker. When this marker pen is used to highlight any portion of the paper surface prepared according to the second embodiment described above, the chemical combination between the color developer and the composite leucodye coating will result appreciably in the development of colors A and B of FIG. 2*a* in the form of the preselected geometric pattern of B colored areas on the A color background according to the prescription of U.S. Pat. No. 4,867,481 (Gundjian).

Other variations in the method of application on to the paper substrate of the two mating chemicals, namely the leucodye coating and the color developer can be as follows.

a) The leucodye of eventual color B printed according to the spatial modulation pattern can be printed first, the uniform coating expected to provide the background color A be applied over this printed pattern next.

b) The pattern of the required color B can be printed first using an ordinary ink of the acquired color; this results in a colored pattern with the required spectral characteristic, according to FIG. 2*a*. The uniform background of color a is obtained by applying an initially colorless leucodye coating as explained before.

c) The pattern required to acquire color B can be printed using an initially colorless appropriate leucodye system, and the background of color a may be reprinted using regular inks that provide an already colored background with the required spectral characteristic.

The specular reflection or simply the gloss characteristic of the color activated and hence colored coating is found to be quite an important element in this invention in order to improve the photocopy prevention properties of such coatings. It is, therefore, also considered that the gloss imparting element an be integrated into the paper coating instead of being loaded to the marker or other dispensing systems for the complimentary chemical system.

Consider now this novel, invented paper, prepared according to either one of the embodiments described above. The coated paper which constitutes one component of the invention is well understood to be originally of some prechosen very reader friendly color with the possibility that the latter be white.

Figure 4:
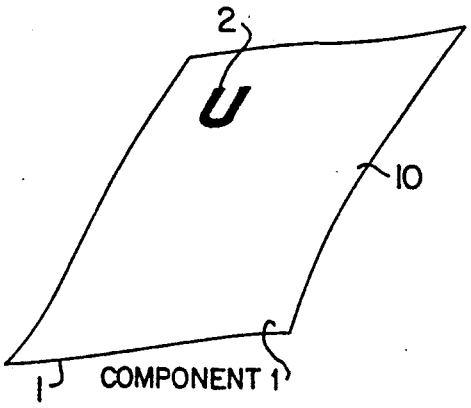
FIG. 4 is a plan view of a security paper according to the invention will information printed thereon.

Information in black or a dark color is now typed or printed using any one of the usually known methods of printing onto this paper as shown in FIG. 4.

The other component of the invention is the complementary chemical to be applied onto the one component utilizing an appropriate applicator.

It is understood, that the complimentary chemical, in the case of the first embodiment is the proper mixture of leucodyes of a given strong concentration in an appropriate solvent as described above, while in the case of the second embodiment, it is a high concentration of a color developer in an appropriate solvent.

The applicator device can be implemented in one of the following ways:

a) A heavy flow highlighter pen containing the complimentary chemical component, integrated into a mix of solvents effective to act on the one component. A glass or specular reflection generating system such as a lacquer will preferably be added to this chemical.

b) A printing ink where the complimentary chemical component is integrated into an appropriate binder, proper solvents for one component and again, preferably a glass generating lacquer. A convention printing press device, large or small, can apply this ink to selected portions of the substrate.

c) Any other device that can carry the complimentary chemical and apply it to the paper substrate.

Figure 5:
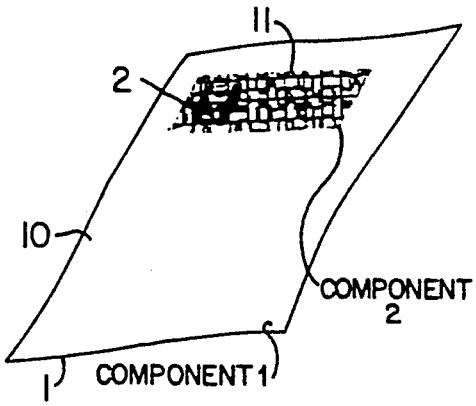
FIG. 5 shows the paper of FIG. 4 with a selected area including the printed information being color formed in accordance with the method of the present invention.

Given now the first component bearing paper substrate 1 with coating 10 thereon carrying the printed information 2 as shown in FIG. 4, the second component applicator e.g. the marker pen is utilized to apply the complimentary chemical coating 11 onto the area carrying the printed information as shown in FIG. 5. The second component can be typically in the form of the highliter pen described above.

Figure 1B:
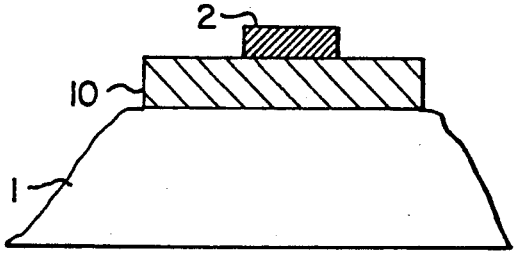
FIG. 1*b* is a cross section of a security paper according to the invention.

It is clear, in FIG. 5, that the color and, therefore, the spectral characteristic of the latter U which is representative of the printed information, will be left essentially unaffected upon the application of the essentially colorless complimentary chemical, which will, however, transform all of the area surrounding the printed letter into the background color and pattern as shown in FIG. 3. This behavior quite evidently results from the simple fact that since the substance that constitutes the letter U, naturally masks the coating of the first component on the paper substrate as shown in FIG. 1*b*, when the complimentary chemical of the second component is applied, the two chemical systems namely the leucodye and color developer can combine to develop the previously described color structure only around and at best under the latter U but surely not on top of the latter U. The attempt to use any sort of blocking film overlay such as sometimes in the form of a thin colored plastic sheet, or a colored ink trace 3, on top of an underlying text 2 or other information, with the purpose of achieving total uncopiability of the latter, is shown in FIG. 1*a*. This method is bound to failure in view of the fact that the color strength or color density of the areas corresponding to the text or information in the original document, is automatically added to that of the overlay film. Thus the absolute value of the contrast differential between the portions of the paper that carry the information, relative to the blank spaces remains unchanged, no matter how strong one renders the overlying film color density. This constant contrast differential attributes a remanent copiability to the text portions even though the paper-film combination darkness is increased.

Figure 6:
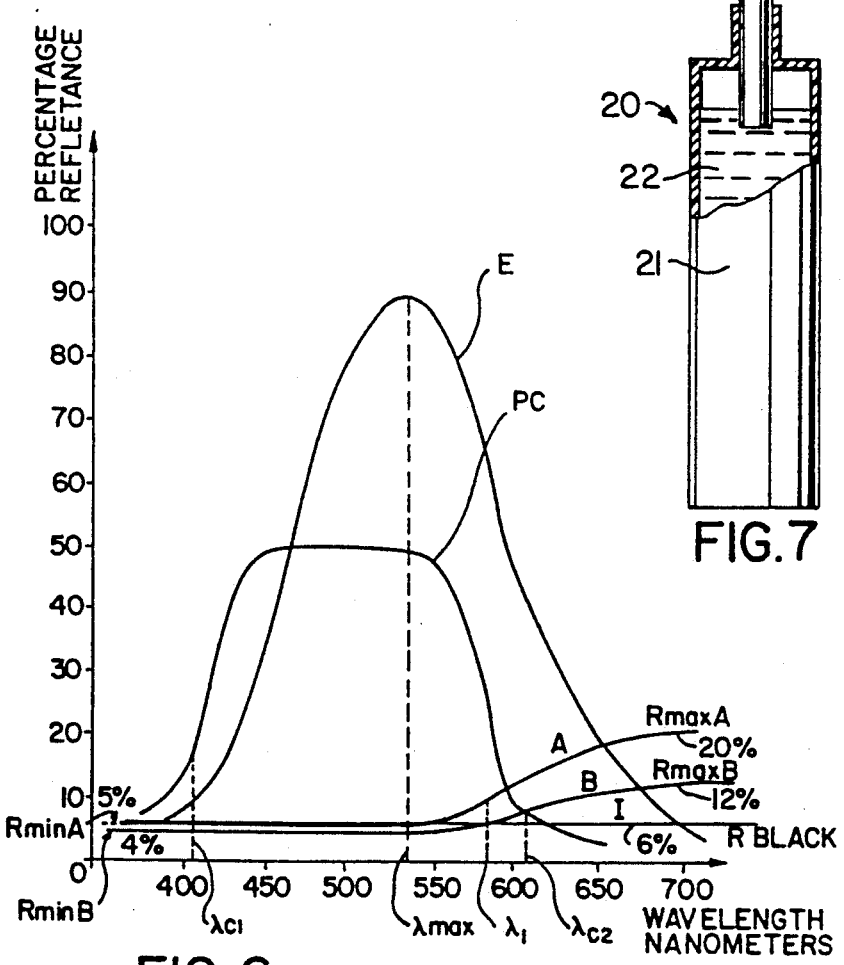
FIG. 6 shows a graph similar to FIG. 2*a* and showing the reflection spectral response of black information.

The spectral characteristic of the black printed letter U and that the surrounding area, are as shown in FIG. 6, where plot "Black" corresponds to a typical black print reflectance and plots A and B represent the spectral modulation in the color that results from the spatial modulation of the spectral characteristic of the paper substrate as described above. The latter U which optically remains above the colored background is still visually readable. It is however, clear that when an attempt is made to photocopy from this paper the information U, the photocopier, as described in the U.S. Pat. No. 4,867,481 (Gundjian) will be unable to distinguish the contrast between the letter U and the surrounding area that carries the spatially modulated spectral modulation represented by plots a and B of FIG. 6. Therefore, the photocopy of the paper substrate, described as carrying the first component of the invention, will properly reproduce the information from every segment of the paper substrate surface except from that which has been highlighted by the complimentary chemical.

It is noted that when the paper specially coated as the substrate for the printing of valuable documents, such documents are automatically protected very effectively against fraudulent attempts of duplication i.e. counterfeiting. Indeed the characteristics of the paper coating are invisible and therefore, undetected by any copying method. Information carried by an unactivated paper substrate may thus be in a first step fraudulently reproduced, however, the fraudulent reproduction can obviously not convey the so-called hidden characteristic of the original substrate to the new substrate. The duplication of the original documents thus now becomes a very simple and effective exercise through the use of a second component chemical system dispenser such as the marker pen shown in FIG. 7.

The marker pen 20 includes a body portion 21 defining a liquid chamber 22 holding one component therein and an applicator tip 23 in liquid communication with the component.

When the latter is applied to the original document the expected colored pattern such as shown in FIG. 3 will appear. The fraudulent reproduction substrate, however, will be absolutely inert and will not be able to develop the expected colored feature when tested with the second chemical system carrying dispenser. Alternatively if the scrambler pattern on the document is activated, the document cannot be copied in a color copier.

EXAMPLE

A first component was applied on a white paper substrate in two steps. A fist uniform layer was applied by a gravure coating process wherein a layer of approximately 0.001 mm thickness was applied. This first layer consisted of a mixture consisting of the following by weight percentage:

Clay 4.5%
Calcium Carbonate 28.50%
Copikem 14, 11.58%
Reakt Red 448, 3%
Copikem 6, 0.42%

Polyvinyl Acetate
in 50% solution in Toluene, 16.66%
Pentalyn A (binder), 3.67%
UV Absorber,
Tinuvin 1130, 1.25%

A second layer was applied by rotogravure printing a pattern as shown in FIG. 3 with an ink which consisted of a mixture consisting of the following by weight percentage.

| | |
|---|---|
| Clay | 2.5% |
| Calcium Carbonate | 28.42% |
| Copikem 14 | 8.92% |
| Copikem 6 | 1.50% |
| Copikem 4 | 4.58% |
| Polyvinyl Acetate in 50% solution in Toluene | 24.00% |
| Pentalyn A (binder) | 1.25% |
| Krumbahr (binder) | 9.93% |
| UV Absorber Tinuvin 1130 | 1.50% |
| Duomeen 0 (disperer) | 0.33% |
| Sodium Hydroxide | 0.42% |
| Toluene | 25.75% |

The second component was stored in an applicator such as shown in FIG. 7 and was a mixture consisting of the following by weight percentage, Dibasic Ester - 28%
Activator HRJ-2609 - 30.5%
Acetone - 40%
Green tracer dye - 1.5%

The second component when mixed with the composite dye content of the first layer produces a first color having a spectral characteristic appreciably following characteristic A of FIG. 6, and when mixed with the superposition of the two layers produces a second color having a spectral characteristic appreciably following characteristic B of FIG. 6.

The present invention covers, of course not only the implementations that have been described above, but also all other alternatives of the above prescribed concepts that can be easily derived from the present description by anyone skilled in this field.

What is claimed is:

1. A method of securing a substrate such as paper against facsimile transmission and photocopying, comprising the steps of:

a) providing a substrate having a background color on one surface thereof;

b) covering at least one selected area of the one surface with Chemical $A_1$ comprising one of a pair of colorless color developer and a colorless color former dye, wherein the color developer and color former dye react when mixed to produce a first given color which is different from the background color and has a spectral response consisting of one of the following: 1) a reflection spectral response A with a minimum of about 5% at lower visible wavelengths, rising to about 10% at a wavelength of about 580 nanometers, and then rising to a maximum of about 20% at about 700 nanometers; 2) a reflection spectral response B with a minimum of about 4% at lower visible wavelengths, rising to about 6% at a wavelength of about 580 nanometers, and then rising to a maximum of about 12% at about 700 nanometers; 3) a reflection spectral response C with a maximum of about 20% at lower visible wavelengths, falling to about 10% at a wavelength of about 480 nanometers, and falling to a minimum of about 8% at higher wavelengths; or 4) a reflection spectral response D with a maximum of about 12% at lower visible wavelengths, falling to about 6% at about 480 nanometers, and falling to a minimum of about 5% at higher wavelengths; and c) printing information in the at least one selected area having a substantially black color with is different from the color of said first spectral response over the wavelengths for the human eye but the same color over the wavelengths of a photocopier and facsimile machine;

d) later applying Chemical $B_1$ comprising the other of the pair of colorless color developer and the colorless color former dye to at least one portion of the at least one selected area to change the background color to said first spectral response when required, whereby information printed in the at least one portion will be readable by a human but be indistinguishable from the background by a photocopier and facsimile machine.

2. The method according to claim 1, wherein the information is printed in the at least one selected area after Chemical $B_1$ is applied.

3. The method according to claim 1, wherein the information is printed in the at least one selected area before Chemical $B_1$ is applied.

4. The method according to claim 1, wherein the step of covering comprises applying Chemical $a_1$ to produce one of spectral responses A and C and applying Chemical $A_2$ comprising one of a second pair to produce a second spectral response selected from one of spectral responses B and D, respectively, to effect a spatially modulated reflection spectral characteristic in said at least one selected area.

5. The method according to claim 4, wherein the spatially modulated reflection spectral characteristic is effected by applying said Chemical $A_2$ with a variable surface density.

6. The method according to claim 5, wherein the step of applying with a variable surface density comprises applying in a regular predefined pattern.

7. The method according to claim 4, wherein the step of applying Chemical $A_1$ comprises applying a first layer of Chemical $A_1$ having a uniform surface density and the step of applying Chemical $A_2$ comprises applying a second layer of Chemical $A_2$ over the first layer having a variable surface density in accordance with the regular predefined pattern.

8. The method according to claim 7, wherein the first layer is a relatively lower activity color developer and the second layer is a relatively higher activity color developer.

9. The method according to claim 4, wherein the step of applying Chemical $A_1$ comprises applying a mixture of different color dyes.

10. The method according to claim 4, wherein the step of applying Chemical $B_1$ comprises applying a single color developer to the surface to effect the spatial modulation.

11. The method according to claim 4, wherein the first and second reflection spectral responses fall to a minimum at wavelengths above 700 nanometers.

12. The method according to claim 4, wherein the first and second reflection spectral responses fall to a minimum at wavelengths below about 400 nanometers.

13. The method according to claim 4, wherein the spatial modulation is effected by printing a scrambling pattern with the spectral response B or D.

14. The method according to claim 1, wherein the step of applying comprises painting a color developer solution on the surface with a handheld applicator.

15. The method according to claim 1, wherein the step of applying comprises printing a color developer solution on the surface.

16. The method according to claim 1, further comprising printing a visible color having spectral response A or C with a uniform surface density in the at least one selected area and wherein the step of covering comprises applying Chemical $A_1$ with a variable surface density having the spectral response B or D respectively.

17. The method according to claim 1, further comprising adding glossing agents to Chemical $A_1$.

18. A system for securing a substrate such as paper against facsimile transmission and photocopying, comprising:

a) a substrate having a background color on one surface thereof;

b) a covering on at least one selected area of the one surface with Chemical $A_1$ comprising one of a first pair of a colorless color developer and a colorless color former dye, wherein the color developer and color former dye react when mixed to produce a first spectral response which is different from the background color and consists of one of the following: 1) a reflection spectral response A with a minimum of about 5% at lower visible wavelengths, rising to about 10% at a wavelength of about 580 nanometers, and then rising to a maximum of about 20% at about 700 nanometers; 2) a reflection spectral response B with a minimum of about 4% at lower visible wavelengths, rising to about 6% at a wavelength of about 580 nanometers, and then rising to a maximum of about 12% at about 700 nanometers; 3) a reflection spectral response C with a maximum of about 20% at lower visible wavelengths, falling to about 10% at a wavelength of about 480 nanometers, and falling to a minimum of about 8% at higher wavelengths; or 4) a reflection spectral response D with a maximum of about 12% at lower visible wavelengths, falling to about 6% at about 480 nanometers, and falling to a minimum of about 5% at higher wavelengths; and c) means for printing information in the at least one selected area having a substantially black color which is different from the color of said first spectral response over the wavelengths for the human eye but the same color over the wavelengths of a photocopier and facsimile machine;

d) means for later applying Chemical $B_1$ comprising the other of the first pair of the colorless color developer and the colorless color former dye to at least a portion of the at least one selected area to change the background color to said first spectral response when required, whereby information printed in the at least one portion will be readable by a human but be indistinguishable from the background by a photocopier and facsimile machine.

19. The system according to claim 18, wherein the background color is white.

20. The system according to claim 18, wherein the background color is a light color.

21. The system according to claim 18, wherein the covering comprises Chemical $A_1$ producing one of spectral responses A and C and Chemical $A_2$ comprising one of a second pair to produce a second spectral response selected from one of spectral responses B and D, respectively, to effect a spatially modulated reflection spectral characteristic in said at least one selected area.

22. The system according to claim 21, wherein the Chemical $A_2$ has a variable surface density to effect the spatially modulated reflection spectral characteristic.

23. The system according to claim 22, wherein the variable surface density comprises a regular predefined pattern.

24. The system according to claim 21, wherein the covering comprises a first layer of Chemical $A_1$ having a uniform surface density and a second layer of Chemical $A_2$ thereover having a variable surface density in accordance with a regular predefined pattern.

25. The system according to claim 24, wherein the first layer is relatively lower activity color developer and the second layer is a relatively higher activity color developer.

26. The system according to claim 231, wherein Chemical $B_1$, comprises a mixture of different color dyes.

27. The system according to claim 21, wherein Chemical $B_1$ comprises a single color developer to effect the spatial modulation.

28. The system according to claim 21, wherein the first and second reflection spectral responses fall to a minimum at wavelengths above 700 nanometers.

29. The system according to claim 21, wherein the first and second reflection spectral responses fall to said minimum of wavelengths below about 400 nanometers.

30. The system according to claim 18, further comprising a visible color having spectral response A or C with a uniform surface density printed in the at least one selected area and wherein the covering comprises Chemical $A_1$ with a variable surface density and having the spectral response B or D respectively.

31. The system according to claim 18, wherein the means for applying Chemical $B_1$ comprises a color developer solution in a handheld applicator.

32. The system according to claim 18, wherein the means for applying Chemical $B_1$ comprises means for printing a color developer solution on the surface.

33. The system according to claim 21, wherein the Chemical $A_2$ comprises a printed scrambling pattern with the spectral response B or D.

34. The system according to claim 18, further comprising glossing agents added to Chemical $B_1$.

35. A security substrate, comprising:

a) one surface having a background color; and b) a covering on at least one selected area of the surface comprising one of a fist pair of a colorless color developer and a colorless color former dye, wherein the color developer and color former dye react when mixed to produce a first spectral response which is different from the background color and consists of one of the following: 1) a reflection spectral response A with a minimum of about 5% at lower visible wavelengths, rising to about 10% at a wavelength of about 580 nanometers, and then rising to a maximum of about 20% at about 700 nanometers; or 2) a reflection spectral response C with a maximum of about 20% at lower visible wavelengths, falling to about 10% at a wavelength of about 480 nanometers, and falling to a minimum of about 8% at higher wavelengths, and comprising one of a second pair of a colorless color developer and a colorless color former dye, wherein the second pair react when mixed to produce a second spectral response which is different from the background color and consists of one of the following: 1) a reflection spectral response B with a minimum of about 4% at lower visible wavelengths, rising to about 6% at a wavelength of about 580 nanometers, and then rising to a maximum of about 12% at about 700 nanometers; or 2) a reflection spectral response D with a maximum of about 12% at lower visible wavelengths, falling to about 6% at about 480 nanometers, and falling to a minimum of about 5% at higher wavelengths and wherein the covering effects a spatially modulated reflection spectral characteristic in said at least one selected area, whereby the printing of information in said at least one selected area having a substantially black color which is different from the color of the spectral responses A, B, C and D will be readable by a human but is indistinguishable by photocopiers and facsimile machines over the wavelengths thereof.

36. The substrate according to claim 35, wherein the background color is white.

37. The substrate according to claim 35, wherein the background color is a light color.

38. The substrate according to claim 35, wherein said one of the second pair has a variable surface density to effect the spatially modulated reflection spectral characteristic.

39. The substrate according to claim 35, wherein the variable surface density comprises a regular predefined pattern.

40. The substrate according to claim 35, wherein said one of the first pair comprises a first layer having a uniform surface density and said one of the second pair comprises a second layer thereover having a variable surface density in accordance with a regular predefined pattern.

41. The substrate according to claim 40, wherein the first layer is a relatively lower activity color developer and the second layer is a relatively higher activity color developer.

42. The substrate according to claim 35, wherein the other of the first pair comprises a mixture of different color dyes.

43. The substrate according to claim 35, wherein the first and second reflection spectral responses fall to a minimum at wavelengths above 700 nanometers.

44. The substrate according to claim 35, wherein the first and second reflection spectral responses fall to said minimum at wavelengths below about 400 nanometers.

45. The substrate according to claim 35, wherein the one of the second pair comprises a printed scrambling pattern with the spectral response B or D.

* * * * *